US006328678B1

(12) United States Patent
Romero

(10) Patent No.: US 6,328,678 B1
(45) Date of Patent: Dec. 11, 2001

(54) WEIGHTLIFTING ASSEMBLY WITH INCORPORATED LOCKING SYSTEM

(76) Inventor: Mark Anthony Romero, 1503 E. Farland St., Covina, CA (US) 91724

( * ) Notice: Subject to any disclaimer, the term of this patent is extended or adjusted under 35 U.S.C. 154(b) by 0 days.

(21) Appl. No.: 09/549,082

(22) Filed: Apr. 15, 2000

Related U.S. Application Data

(60) Provisional application No. 60/129,677, filed on Apr. 16, 1999.

(51) Int. Cl.[7] ..... A63B 21/075
(52) U.S. Cl. ..... 482/106; 482/93
(58) Field of Search ..... 482/106–108, 482/93; D21/680–681

(56) References Cited

U.S. PATENT DOCUMENTS

D. 194,042 * 11/1962 Guthormsen ..... 482/106
3,913,908 * 10/1975 Speyer ..... 482/107
5,853,355 * 12/1998 Standish ..... 482/106

* cited by examiner

*Primary Examiner*—John Mulcahy
(74) *Attorney, Agent, or Firm*—Kilpatrick Stockton LLP

(57) ABSTRACT

An improved weightlifting assembly, such as a barbell, incorporating a locking system comprising a buffer plate having a locking key to serve as a securement means and randomly fasten weight plates to the bar. The weightlifting assembly provides for a bar and oversized weight plates which fittingly interlock together in order to prevent the rolling, separation or spreading of the weight plates across or off the bar. Here, the weight plates have two opposing ends preferably including a fifty percent minimum clearance to allow the user to properly handle, lift and control the oversized weight plates.

6 Claims, 3 Drawing Sheets

WEIGHTLIFTING ASSEMBLY WITH INCORPORATED LOCKING SYSTEM

RELATED PATENT APPLICATIONS

This patent application claims priority to U.S. Provisional Application No. 60/129,677 filed Apr. 16, 1999 and entitled EXERCISE WEIGHT ASSEMBLY. Said application in its entirety is hereby expressly incorporated by reference into the present application.

DESCRIPTION

1. Technical Field

The present invention relates to a weightlifting assembly, namely a barbell, which incorporates a locking system in order to prevent separation, spreading or rolling of weight plates from the bar. Furthermore, the present invention features improved oversized weight plates adapted to interlockingly engage with one another for enabling the user to maintain proper handling and body positioning when lifting the weight plates.

2. Background of the Invention

No longer a male dominated sport, weightlifting has gained increased popularity among the general population. The daily user currently recognizes barbells and weight plates to be effective strength training devices available for sculpting one's physique while allowing the user to build both flexibility and balance. Further, physical therapists utilize these weightlifting devices and therapies to aid patients in healing muscle and joint injuries, while also increasing muscle mass, if so desired. However, the present weightlifting devices have several disadvantages pertaining to both the barbell assembly and the weight plates thereby preventing the user from obtaining optimal results.

Traditionally, the use of barbells primarily required the user to remove collars at either end of the bar in order to add or remove weight plates which consumed valuable time and energy. Within the past few years, snap-action locking devices have been utilized to decrease the amount of energy required to loosen the collar before its removal. However, it was still necessary for the collar to be removed from the bar in order for the weight plates to be slipped on or off the end of the bar.

An example of a traditional locking device is claimed in U.S. Pat. No. 3,913,908 issued to Speyer on Oct. 21, 1975 disclosing a barbell having a detachably mounted weight supporting bar. The '908 patent provides a barbell for supporting removable weights including a hollow rod having flanges affixed at each of it terminal ends and a pair of bar members. In particular, each of the bar members has a locking device affixed thereto in order to retain the bar member in the hollow interior of the rod and retarding the movement of the bar member axially of the rod. The locking device features an eccentrically mounted, rotatable camming member affixed to the end of each of the bar members whereby the camming member is lockingly engageable with the rod in response to rotation of the bar member in either direction.

Aside from the barbells as a unit, conventional weight plates have themselves presented numerous disadvantages to the user. Typically, weight plates are disc-shaped and have an opening in the center for mounting the weight plates onto a barbell bar. A primary problem is that weight plates are difficult for the user to maneuver and pick up when lying flat against an adjacent hard surface such as the floor or another weight plate. Further, if a weight plate is laying flat on a smooth surface, such as a weight mat, it may be impossible for the user to pick the weight plate up without moving it across the floor to a location where the user can properly grasp and handle the plate.

Some weight plates include a raised flange formed around the periphery of one side of the plate. The flange enables a user to grip the weight plate easily in order to lift and carry the plate. However, when the weight plate Is left in a downward position with the flange abutting the floor or another adjacent weight, the user is confronted with the same difficulty of lifting and raising the weight plate.

An example of such a weight plate is demonstrated in U.S. Design Pat. No. 355,007 issued to Rojas et al. on Jan. 31, 1995 entitled Weight-lifting Plate. Here, the Rojas patent discloses an ornamental weight-lifting plate having a raised flange on both sides of the plate and a pair of diametrically opposed openings within the plate. However, this patent fails to disclose an interlocking weight plate designed to avoid rolling, spreading or improper weight shifting of the plate across the bar.

Another example is U.S. Design Pat. No. 194,042 issued to Guthormsen on Nov. 13, 1962 entitled Bar Bell or Similar Article. The '042 patent discloses an ornamental weight plate having a staggered cross section. Each side of a plate includes four projections located ninety degrees from one another. However, this particular design does not allocate the projections to be of sufficient height to enable a user to place their fingers between the plate and an adjacent surface in order to aid in maneuvering the plates.

Further, U.S. Pat. No. 5,853,355 issued to Standish on Dec. 29, 1998 discloses a Manipulatable Weight Plate. This weight plate includes a disk body having two generally opposed sides that are oriented radially with respect to the central axis and terminates in circumferential edges. An outer periphery surface extends between the circumferential edges of the two sides where at least one recess is contained in the disk body and opens into the outer periphery surface. Here, the '355 weight plate allows radial insertion of at least one human finger therein so that the user's finger can apply an axial force against the disk body to displace it away from an adjacent surface that is contacting one of the sides of the disk body. However, due to unsuitable body and hand positioning, improper handling, lifting and control along with medical injuries will result.

In view of the above described deficiencies associated with the use of conventional weightlifting devices, such as barbells and weight plates, the present invention has been developed to alleviate these drawbacks and provide further benefits to the user. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventionally designed barbells and weight plates and incorporates several additional beneficial features.

As described herein above, a standard barbell comprises an elongate handle or bar and a plurality of separate removable end weights mounted upon the bar. The end weights are generally disc-shaped and have an opening in the center for mounting the weight plate onto a barbell bar. Some weight plates specifically include a raised flange formed around the periphery of one side of the plate. Further, many barbells require the removal of collars at either end of the bar in order to add or remove weights by passing the bar through a centrally disposed bore in the weight. Unlike the abovementioned conventionally designed weightlifting devices, the present invention is an improved weightlifting assembly which in one aspect incorporates a locking system, namely a collar, with an incorporated locking system to allow the user to add, remove and fasten the weight plates to the barbell in a safe and efficient manner.

The present weightlifting assembly comprises a bar, one or more collars permanently affixed at either end of the bar, weight plates of an improved design and a conventional securement mechanism. A preferred embodiment of the present invention is to provide improved weight plates having off-set body portions that effectively establish raised flanges that have beveled edges. Preferably, the raised flanges are positioned on two opposing sides of each plate and are radially oriented with respect to the central bore. The raised flanges preferably have a 50% rise from the balance of the weight plate. In turn, the beveled edges allow the flanges of each weight plate to interlockingly engage an adjacent plate in order to releasably fasten those plates together and create a form-fit unit. Further, each weight plate is configured to fittingly abut a collar, where each collar has a locking system that is engageable with the adapted weight plates in order to secure the plates to the bar. Each collar may serve as a 2.5 pound weight plate substitute and may be constructed from such materials as steel, iron, or aluminum; however, the collar is neither limited to such poundage or materials.

An advantage of the present invention is to provide an improved weightlifting assembly with an incorporated locking system, namely a collar, to allow the user to attach, remove and secure the weight plates to the bar. Each collar is permanently affixed to the bar in order to reduce wasting the user's valuable time and energy when adding or removing the weight plates to the bar. The collar has a beveled edge to receive weight plates in a fitted manner in order to prevent separation, spreading or rolling of the weight plates along the bar.

Another advantage of the present invention is to provide weight plates having raised flanges located on two opposing sides of the plates allowing the user to maintain proper hand and body positioning and balance when lifting, handling and controlling the oversized plates. Specifically, the raised flanges allow the user to easily grip a weight plate, especially when such plate is lying against a hard surface. Further, the raised flanges are designed to eliminate improper lifting and help the user reduce the risk of pulling muscles as well as to avoid pinched, smashed or broken digits when trying to manipulate a weight plate. Furthermore, the weight plates include a beveled edge with the raised flange in order to allow the weight plates to interlock with one another to prohibit any rolling, spreading and improper weight shifting of the weight plates across the bar.

Additionally, the present invention provides a barbell having an ergonomically correct design, namely permanently affixed collars and interlocking weight plates, in order to reduce or even eliminate future injuries to a user. The improved weightlifting system is designed to increase a user's muscle and joint endurance while maintaining flexibility. Further, the present invention provides a modified weightlifting system with an incorporated locking system that does not require special technology for its production and is easy and inexpensive to manufacture.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale where some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
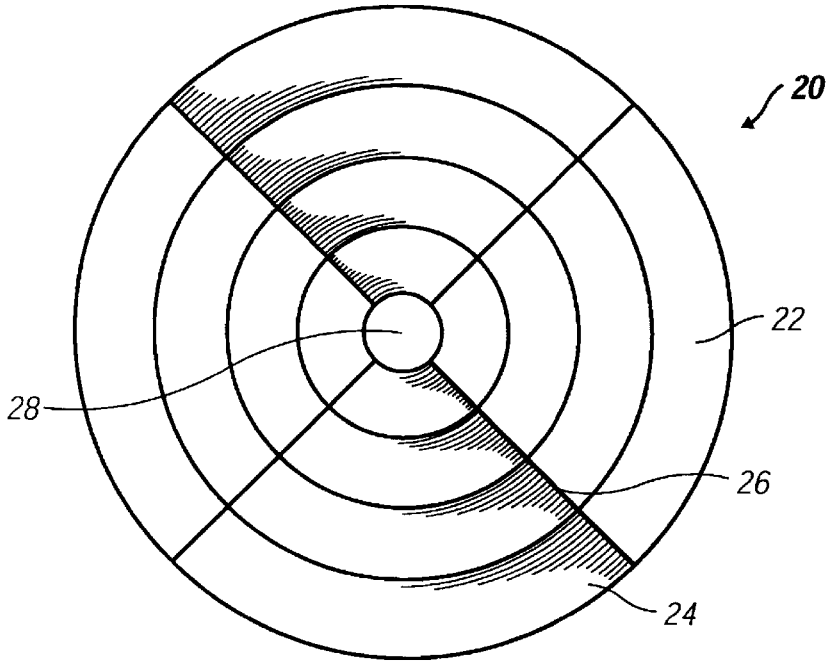
FIG. 1 is a front elevational view of an improved weight plate having raised flanges positioned on two opposing sides and oriented radially with respect to the central axis.
Figure 2:
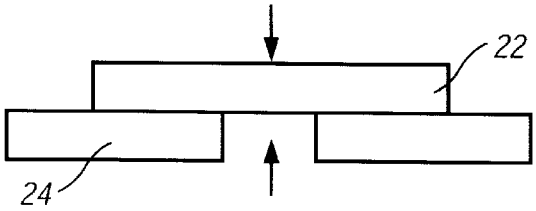
FIG. 2 is a side view of an improved weight plate comprising non-raised portions and raised flanges having a minimum clearance from the non-raised portion.

FIG. 1 illustrates an improved weight plate 20 comprising a central bore 28, at least two raised flanges 22, at least two non-raised portions 24 and beveled edges 26. The raised flanges 22 are preferably positioned on two opposing sides of the weight plate 20 oriented radially with respect to the central bore 28 to act as a gripping guidance system. In turn, the non-raised portions 24 are located on the remaining two opposing sides of the weight plate 20 also being oriented radially with respect to the central bore 28. Each raised flange portion 22 and each non-raised portion 24 has a connector 26 which serves as a connective interface between the portions 22, 24. The connectors 26, preferably beveled edges, are positioned between the raised flanges and the non-raised portions. The beveled edges 26 connect a raised flange 22 preferably at a 50% clearance to a non-raised portion as depicted in FIG. 2. The clearance being measured with respect to a thickness of the portions 22, 24.

Figure 3:
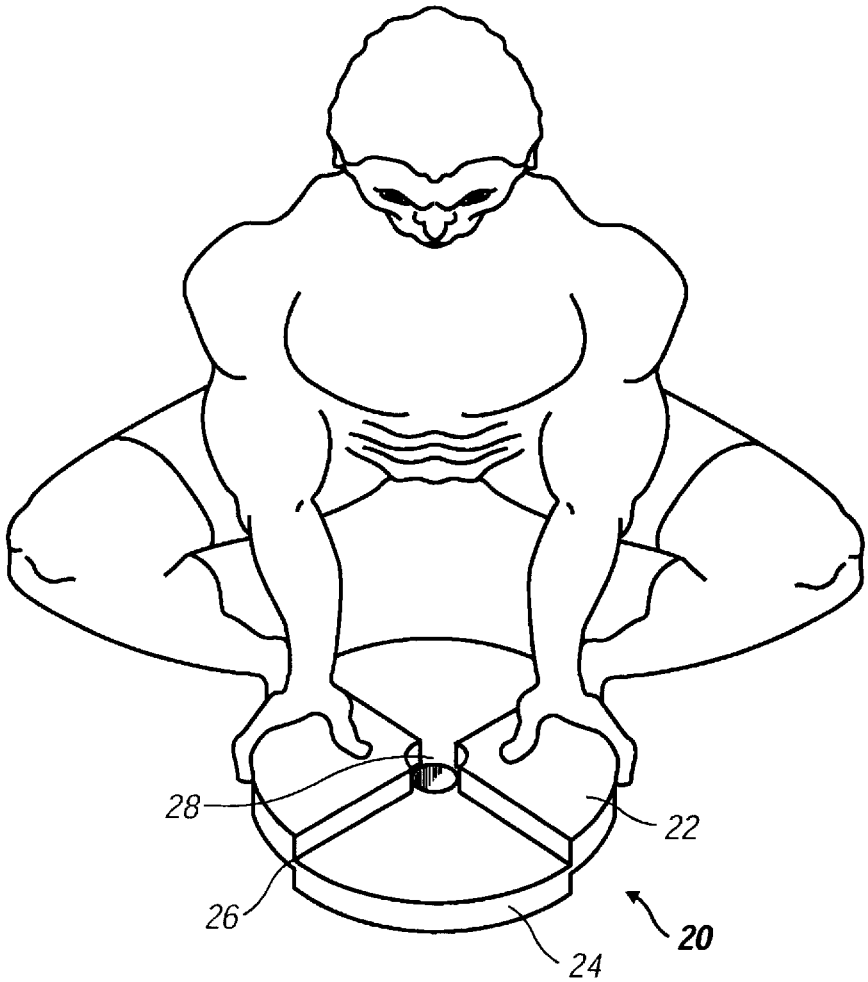
FIG. 3 is a perspective view showing a user lifting a weight plate by using the two opposing raised flanges thereby allowing him to grip the plate while maintaining proper body positioning.

FIG. 3 shows an improved weight plate 20 lying against a hard surface such as a floor. Specifically, the non-raised portions 24 of the weight plate 20 lie against the floor, as the two opposing raised flanges 22, preferably having a 50% rise, allow the user to place his/her hands on the raised flanges 22 with fingers extended around and under the flanges 22 in order to grip and lift the weight plate 20. As a result, the user is able to lift the weight plate 20 while maintaining proper hand and body positioning.

Figure 4:
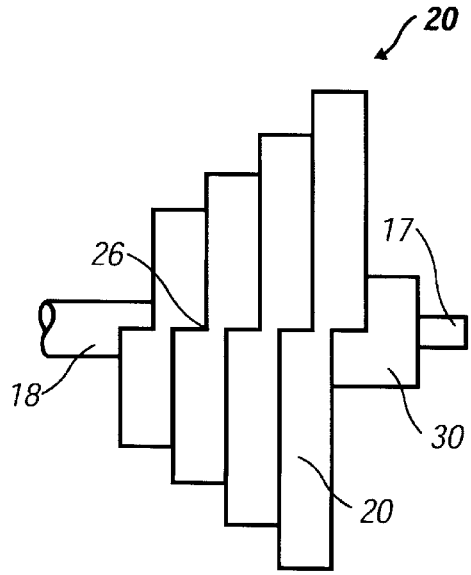
FIG. 4 is a side perspective view of a series of improved weight plates according to the present invention having raised flanges and beveled edges which connect each raised flange to the non-raised portion of the weight plate thereby allowing each weight plate to fittingly interlock with one another.

FIG. 4 illustrates improved weight plates 20 having beveled edges 26 which connect each raised flange 22 to each non-raised portion 24 of the weight plate 20. The beveled edges 26 of each weight plate 20 allow an individual plate 20 to fittingly interlock with another weight plate 20 thereby preventing separation, rolling or improper weight shifting of the plates 20 across the bar 10. At least one improved weight plate 20 fittingly abuts a collar 30 which includes a locking system 15. The locking system 15 is preferably a beveled edge capable of receiving one or more weight plates 20 in a form-fit manner. In particular, the locking system 15 engages a beveled edge 26 of the weight plate in order to secure a singular or plurality of weight plates 20 to the bar 10.

The collar 30 having an exteriorly directed beveled side or end 19 and an oppositely positioned and interiorly directed non-beveled side or end 16 is permanently mounted onto the bar 10. Each collar 30 may serve as a 2.5 pound weight plate substitute and may be constructed from materials such as steel, iron, or aluminum; however the collar 30 is neither limited to such poundage or materials.

Figure 5:
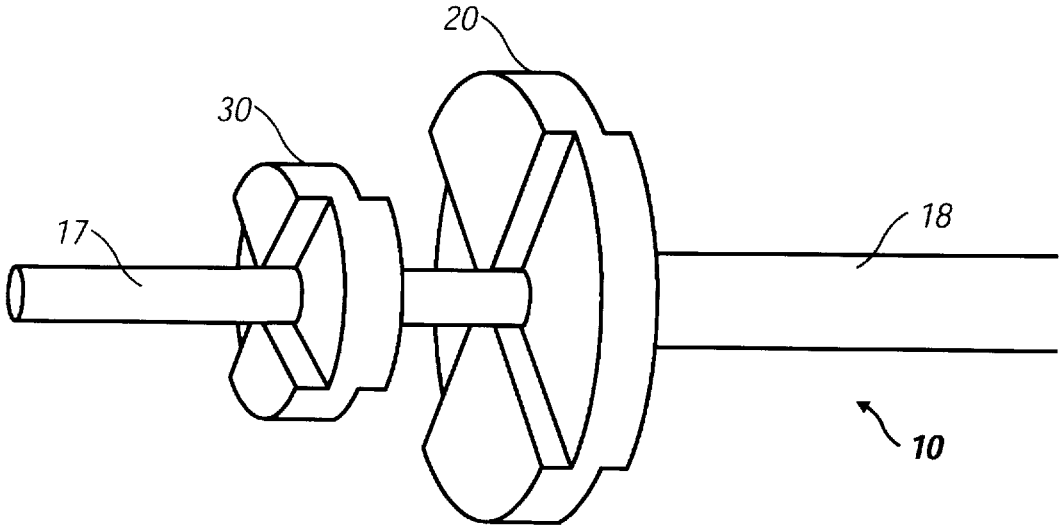
FIG. 5 is a side perspective view of a collar permanently fixed onto the bar and an improved weight plate being positioned to fittingly abut the collar.
Figure 6:
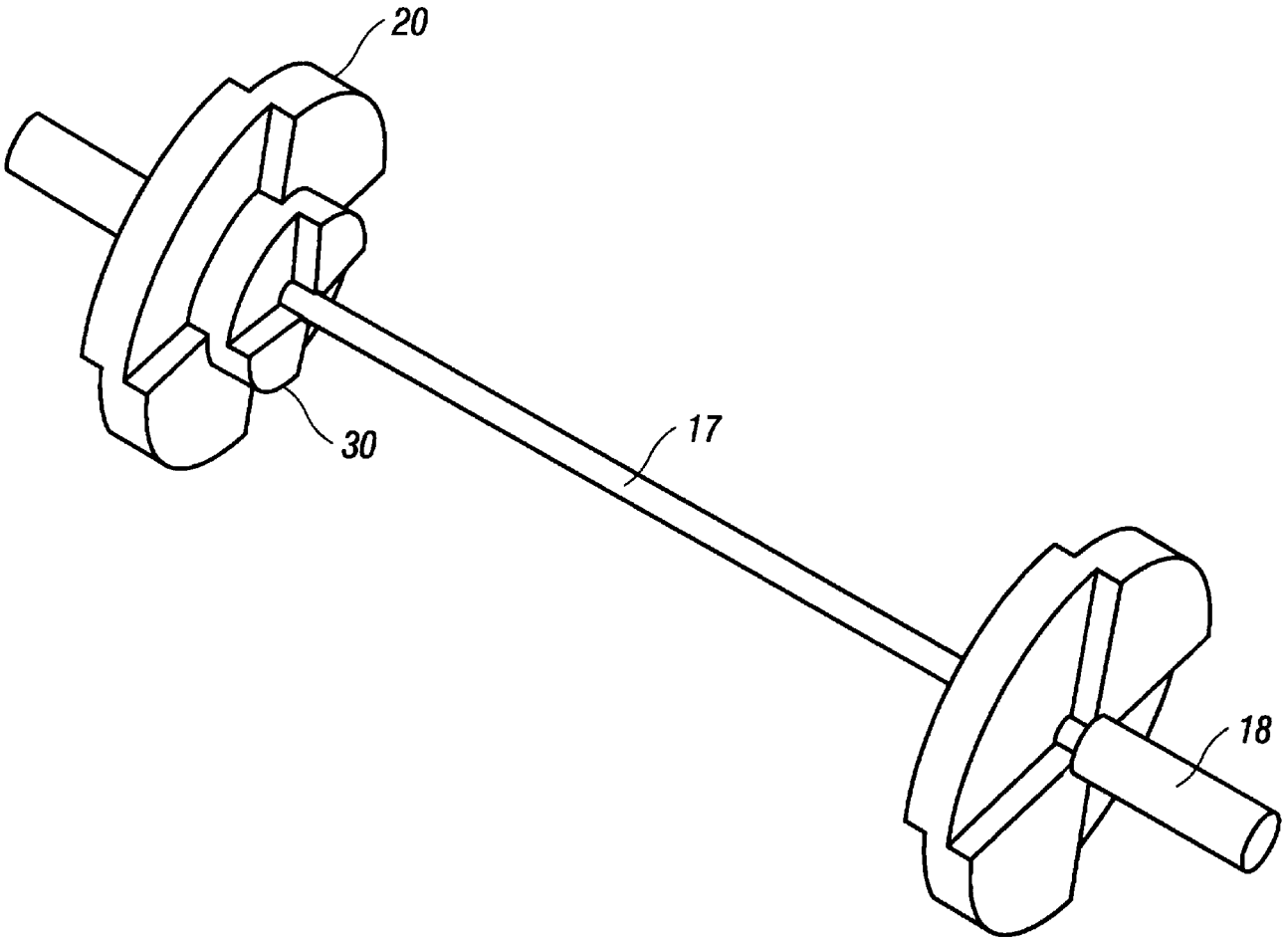
FIG. 6 is a perspective view of the improved weightlifting system focusing on improved weight plates abutting a receiving collar that is permanently attached to the bar.

As seen in FIGS. 5 and 6, the bar 10 has a grip bar potion 17 and a sleeve portion 18. A collar 30 is fixedly attached onto each end of the bar portion 17 of the bar 10. As a weight plate 20 is mounted onto the bar 10, the plate 20 is slid across the sleeve portion 18 of the bar 10 until one end of the weight plate 20 abuts the beveled edge end 19 of the collar 30. A beveled edge 26 of the weight plate 20 is then positioned to interlock with the beveled edge 15 of the collar 30 in order to fasten the weight plate 20 in a secure manner. Once the beveled edge 26 of the weight plate 20 is interlockingly fastened to a collar 30, the free end of the weight plate 20 is abutted by a conventional securement mechanism such as a clamp, a screw apparatus or a spring mechanism. The securement mechanism, like the weight plate 20, is slid across the sleeve portion 18 of the bar 10 until the mechanism is adjacent to the free end of the weight plate 20. Then, the securement mechanism is fastened onto the sleeve portion 18 of the bar 10 whereby the user may safely engage in weightlifting exercises.

INDUSTRIAL APPLICABILITY

The present invention finds specific applicability in the physical fitness, physical therapy and sports industries.

What is claimed and desired to be secured by Letters Patent is as follows:

1. A method for facilitating the utilization of a weightlifting assembly, said method comprising:

providing a collection of weightlifting assembly components, said weightlifting assembly components including a plurality of weight plates, each of said weight plates having a central bore adapted to be removably installed upon a carrying weight bar and an outer periphery;

including a gripping guidance system on each of said weight plates, said gripping guidance system being configured to direct a user's pair of gripping hands to substantially opposite positions on said weight plates;

said gripping guidance system including each of said weight plates having a pair of opposed raised flange portions and a pair of opposed non-raised flange portions between said raised flange portions, each of said raised and non-raised flange portions extending radially from an inner end at said central bore to an outer end on said outer periphery, each of said raised flange portions having a clearance space defined therebelow when said weight plate is resting on a flat surface, said clearance space being of sufficient depth to accept insertion of a user's grasping fingers therein; and facilitating the installation process of said weight plates onto said carrying weight bar by encouraging proper lifting technique of the individual weight plates via said gripping guidance system for safe manipulation by the user.

2. The method for facilitating the utilization of a weightlifing assembly as recited in claim 1, said method further comprising:

installing a plurality of said weight plates on a bar, said installation process involving a user squatting adjacent to said plurality of weight plates individually and then being guided to a safe-grip orientation through the presence of said gripping guidance system provided on each weight plate.

3. The method for facilitating the utilization of a weightlifting assembly as recited in claim 2, wherein said step of providing a collection of weightlifting assembly components further comprises providing at least two weight plates.

4. The method for facilitating the utilization of a weightlifting assembly as recited in claim 2, wherein said step of providing a collection of weightlifting assembly components further comprises providing at least two collars.

5. The method for facilitating the utilization of a weightlifting assembly as recited in claim 1, said method further comprising:

configuring connectors, including beveled edges, to unite said raised flange portions to said non-raised flange portions, said beveled edges being further configured to allow said weight plate to fittingly interlock with adjacent weight plates.

6. The method for facilitating the utilization of a weightlifing assembly as recited in claim 5, said method further comprising:

configuring said beveled edges to connect said raised flanges at a fifty percent clearance to said non-raised flange portions.

* * * * *